US006073390A

United States Patent [19]

Baudier

[11] Patent Number: 6,073,390

[45] Date of Patent: Jun. 13, 2000

[54] CHRISTMAS TREE WATERING DEVICE

[76] Inventor: Stephen R. Baudier, 9 Jamestown Dr., Conway, Ark. 72032

[21] Appl. No.: 09/216,998

[22] Filed: Dec. 21, 1998

[51] Int. Cl.[7] ..... A47G 7/02

[52] U.S. Cl. ..... 47/40.5

[58] Field of Search ..... 47/40.5, 48.5, 47/79; 340/620, 618, 623, 624

[56] References Cited

U.S. PATENT DOCUMENTS

| | | | |
|---|---|---|---|
| 1,213,444 | 1/1917 | Aberle . | |
| 1,373,420 | 4/1921 | Grah . | |
| 1,676,565 | 7/1928 | La Vallee et al. . | |
| 3,673,587 | 6/1972 | Baruch | 340/450 |
| 4,796,017 | 1/1989 | Merenda | 340/620 |
| 5,473,838 | 12/1995 | Denbigh | 47/40.5 |
| 5,493,277 | 2/1996 | Pierce et al. | 340/620 |
| 5,513,677 | 5/1996 | McCurry | 141/1 |
| 5,575,110 | 11/1996 | Couture | 47/40.5 |
| 5,615,516 | 4/1997 | Brown | 47/40.5 |
| 5,791,083 | 8/1998 | Giangrossi | 47/40.5 |
| 5,799,437 | 9/1998 | Evans et al. | 47/40.5 |
| 5,867,929 | 2/1999 | Jung et al. | 47/40.5 |
| 5,894,695 | 4/1999 | Stellatos | 47/40.5 |

*Primary Examiner*—Peter M. Poon
*Assistant Examiner*—Judith A. Nelson
*Attorney, Agent, or Firm*—Ray F. Cox, Jr.

[57] ABSTRACT

A Christmas tree watering device for adding water to the water reservoir of a Christmas tree stand. A funnel-like opening for receiving water is disguised as a Christmas tree ornament. The disguised ornament is provided with a hinged section that opens to provide access to the hollow interior. The hinged section prevents debris from falling into the opening and serves to disguise the device. The interior of the disguised ornament communicates with a flexible tube to the reservoir located at the base of the tree. A warning mechanism to ensure that the reservoir is not filled to overflowing has a float that rises and falls with the water level in the reservoir, a bell, and a striker on the float arranged to contact the bell when the correct water level has been reached. The warning mechanism may be clipped to the lower end of the flexible tube or may be provided with a hook to hook over the side of the reservoir.

6 Claims, 4 Drawing Sheets

CHRISTMAS TREE WATERING DEVICE

BACKGROUND OF THE INVENTION

The present invention relates to a device for adding water to the water reservoir of a cut live tree, and in particular to such a device for use with Christmas trees where the water is introduced through a funnel disguised as an ornament.

A common holiday decoration is the Christmas tree. Although artificial trees are often used, many still prefer the cut live tree which is maintained through the holiday season in a stand made for this purpose. Such stands typically require a water reservoir to maintain the tree in a living state for a period of time. Without such a reservoir the tree will soon dry out, resulting in the browning and loss of foliage. Not only does this result in a tree that is unattractive but it may be a safety hazard as well since the dry foliage is liable to catch fire if exposed to a source of heat such as the typical holiday lights.

Since the cut tree must often be maintained for several weeks through the holiday season and a considerable amount of water is required by the cut tree during this span of time, it is a serious and repetitive chore to constantly check the level of water in the reservoir and to refill the reservoir as necessary. This chore is complicated and rendered more onerous by the difficulty of access to the reservoir. The reservoir must of necessity be located at the base of the tree where it is covered by the lower branches of the tree. The branches present an obstacle to anyone needing to obtain access to the water reservoir. Holiday decorations and presents also offer an obstacle to obtaining access to the reservoir.

A number of attempts have been made to develop watering systems which minimize the problems of dealing with the Christmas tree reservoir. A simple solution is to employ some sort of funnel and tube arrangement to allow water to be added to the reservoir from a point of easy access. In order to avoid an overly obtrusive arrangement, it has been suggested that the funnel be disguised as a Christmas tree ornament. For example, U.S. Pat. No. 5,615,516 issued to Brown discloses a generally spherical hollow ball resembling a Christmas tree ornament. It is provided with a channeling surface and back splash to assist in directing water into a hollow interior that communicates with a flexible tube to carry water to the reservoir at the bottom of the tree.

Another problem in developing a Christmas tree watering device is how to know when the reservoir is full. Alarms for warning when a container is full are known in various arts. For example, Aberle (U.S. Pat. No. 1,213,444) discloses an overflow signal device that comprises a float attached to a rod which moves vertically in a slot in a horizontal holding arm. At its maximum vertical extent the rod hits a trigger which sounds a spring bell. Aberle also discloses a clamp mechanism for clamping the device to the side of a water reservoir. Aberle's mechanism is quite complicated in that the trigger acts to set off a spring alarm rather than sounding a bell directly. Since the Aberle alarm is a spring bell, it apparently requires rewinding and resetting after each use which would defeat the purpose of an alarm used to avoid the difficulty of obtaining access to a Christmas tree stand reservoir.

U.S. Pat. No. 5,575,110 issued to Couture discloses the combination of a Christmas tree watering device and an alarm feature. Likewise, Pierce et al. (U.S. Pat. No. 5,493,277) shows a combination of a Christmas tree watering device with an alarm to prevent overfilling.

The limitations and disadvantages of the prior art are overcome by the present invention as described following.

SUMMARY OF THE INVENTION

The present invention is a Christmas tree watering device. The device may be used for adding water to the water reservoir typically found in a Christmas tree stand. The invention comprises a funnel-like opening for receiving water to be added to the reservoir. The funnel-like opening is disguised as a Christmas tree ornament so that it may be readily accessible, yet not out of place when hung from a branch of the Christmas tree. Preferably the funnel is spherical in shape, but other ornamental shapes are contemplated as being within the scope of the present invention. The disguised ornament is provided with a hinged section that opens to provide access to the hollow interior. The hinged section prevents debris from falling into the opening and serves to disguise the device completely.

The interior of the disguised ornament is preferably provided with a nipple on the exterior to which a flexible tube may be attached. The flexible tube is led through the interior of the Christmas tree to the reservoir located at the base of the tree.

The present invention also provides for a warning mechanism to ensure that the reservoir is not filled to overflowing. The warning mechanism comprises a float that rises and falls with the water level in the reservoir, a bell, and a striker on the float arranged to contact the bell when the correct water level has been reached. The warning mechanism may be clamped to the lower end of the flexible tube or may be provided with a hook to hook over the side of the reservoir.

It is therefore an object of the present invention to provide for a Christmas tree watering device which is easily accessible.

It is a further object of the present invention to provide for a Christmas tree watering device which has a funnel for filling the Christmas tree stand water reservoir and which is disguised as a Christmas tree ornament.

It is also an object of the present invention to provide for a Christmas tree watering device with a disguised funnel which is provided with a hinged access cover.

It is a still further object of the present invention to provide for a warning mechanism to prevent overfilling the reservoir which is simple and reliable and which may be operated multiple times during the Christmas tree season without the necessity of access to the alarm.

These and other objects and advantages of the present invention will be apparent from a consideration of the following detailed description of the preferred embodiments in conjunction with the appended drawings as described following.

DETAILED DESCRIPTION OF THE PREFERRED EMBODIMENTS

Figure 1:
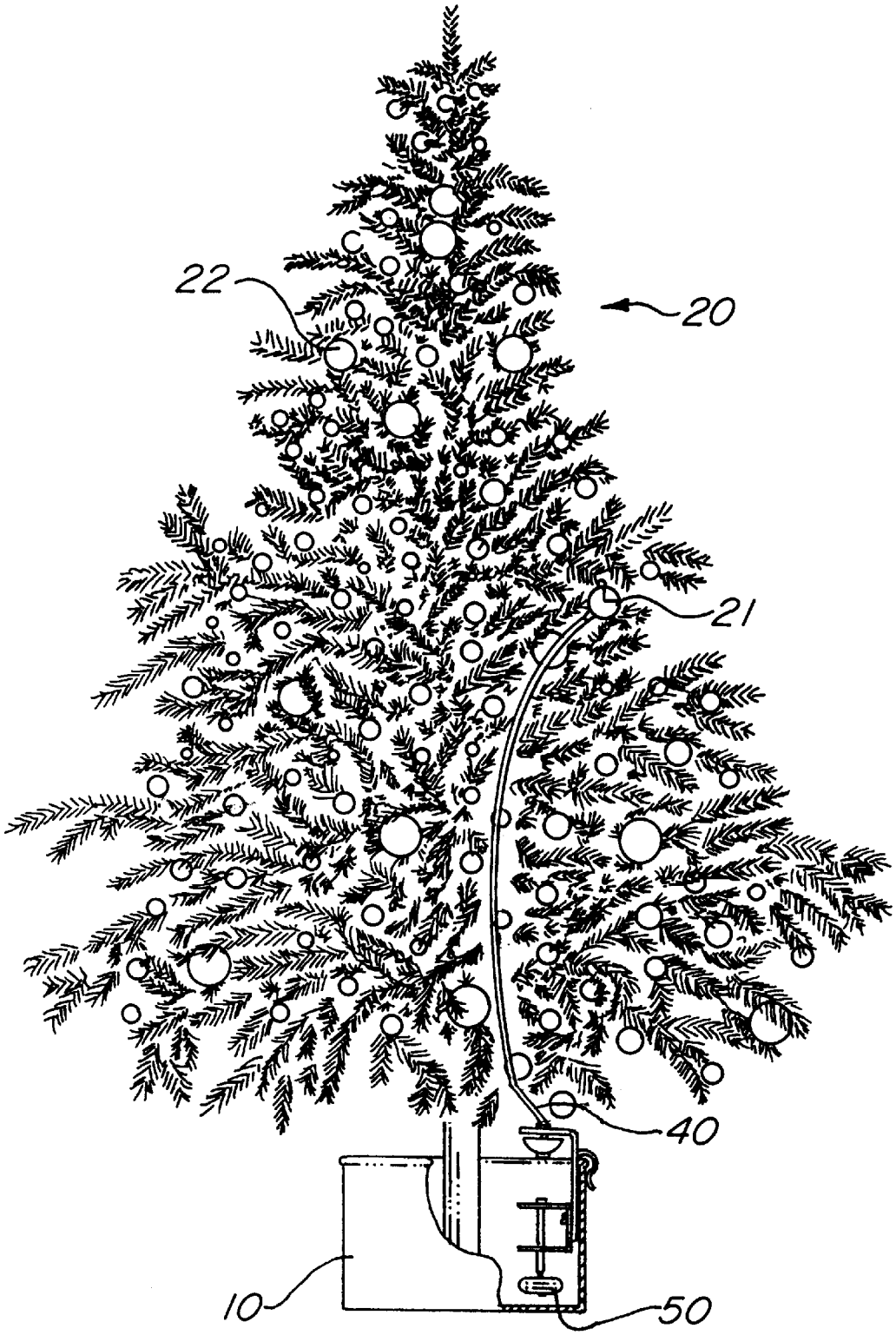
FIG. 1 is a front elevational view of a Christmas tree in a partially sectioned water reservoir showing the present invention in an embodiment in which the water level warning mechanism is attached to the water reservoir by a hook over the side of the water reservoir.

With reference to FIG. 1, the preferred embodiment of the present invention may be described. The present invention is a device for adding water to the water reservoir 10 for a live, cut tree 20 kept indoors, such as a Christmas tree. The invention comprises a funnel-like opening for receiving water to be added to the reservoir 10. The funnel-like opening is disguised as a Christmas tree ornament so that it may be readily accessible yet not obtrusively out of place when hung from a branch of the Christmas tree 20. In one embodiment, the disguised funnel 21 is a spherically shaped object substantially identical to common Christmas tree ornaments 22. It is likewise provided with hanging means 30 similar to standard means for hanging Christmas tree ornaments 22.

Figure 2:
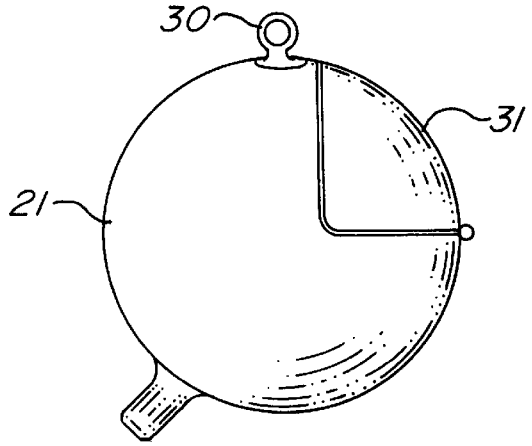
FIG. 2 is a front elevational view of the watering funnel disguised as a Christmas tree ornament. The hinged opening providing access to the interior of the watering funnel is shown in the closed position.
Figure 3:
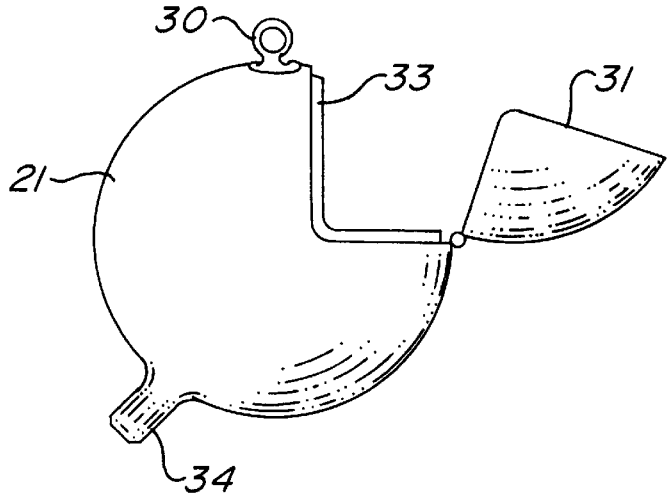
FIG. 3 is a front elevational view of the watering funnel disguised as a Christmas tree ornament. The hinged opening providing access to the interior of the watering funnel is shown in the open position.
Figure 4:
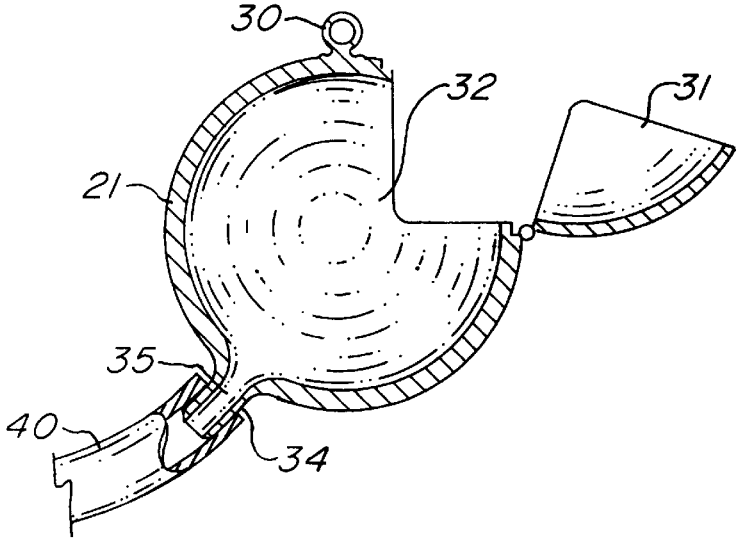
FIG. 4 is a sectioned front elevational view of the watering funnel with the hinged opening in the open position and showing the flexible watering tube attached to the nipple communicating with the interior of the watering funnel.

As shown in FIGS. 2–4, the disguised funnel 21 is provided with a hinged section 31 which opens to provide access to the interior 32. When closed, the hinged section 31 effectively disguises the purpose of the disguised funnel 21 and appears identical to a Christmas tree ornament 22. Optionally, the hinged section 31 may be provided with fastening means (not shown) of various types which would be well known to those skilled in the art. The hinged section 31 not only completes the disguise of the funnel 21 but it prevents debris from entering the opening 33 and perhaps obstructing the flow of water to the reservoir 10.

The disguised funnel 21 is provided with an opening 33 communicating with the interior 32 of the funnel 21. The interior 32 preferably leads into a nipple 34 on the exterior of the disguised funnel 21 to which a flexible tube 40 may be attached. A clamp or other means may be employed to attach the flexible tube 40 to the nipple 34. Preferably the nipple 34 is oriented so as to allow the flexible tube 40 to be hidden within the branches of the Christmas tree 20. A conduit 35 through the nipple 34 communicates between the interior 32 of the funnel 21 and the hollow interior 36 of the flexible tube 40 so that water passed into the interior 32 of the funnel 21 through the opening 33 would by gravity pass through the conduit 35 of the nipple 34 into the flexible tube 40 and thence to the reservoir 10.

The flexible tube 40 may be hidden by placement in the interior of the Christmas tree 20 adjacent to the trunk and carried thence to the reservoir 10 located at the base of the tree 20. It may be seen then that water introduced into the open disguised funnel 21 is carried by the flexible tube 40 directly to the reservoir 10 without the necessity of introducing a watering device directly into the reservoir 10, which is normally accessible only with great difficulty and requires negotiating the lower tree limbs, the ornaments arrayed thereon, and any packages or decorations arranged around the bottom of the tree 20.

Figure 6:
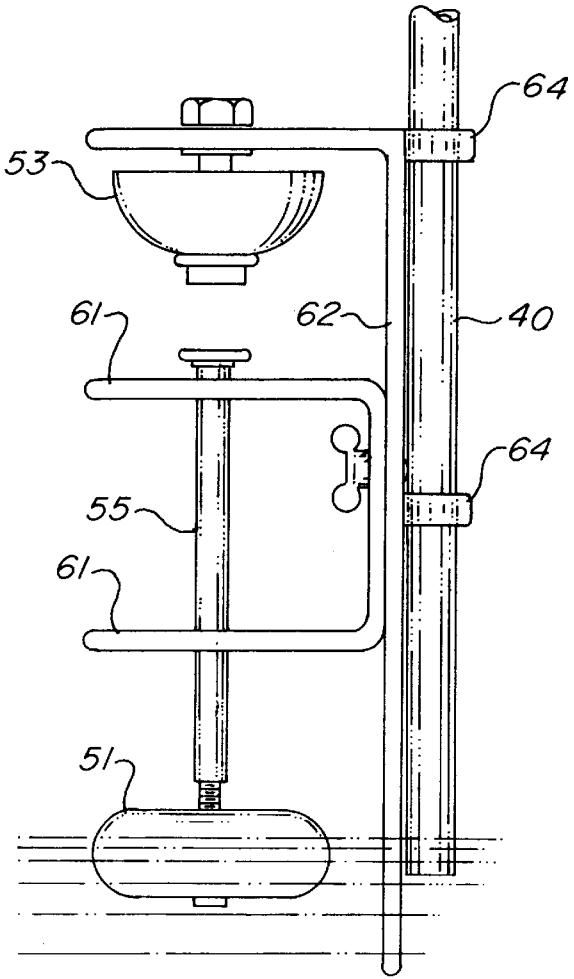
FIG. 6 is is a front elevational view of the water level alarm warning device in the embodiment that attaches to the flexible tubing by a plurality of clips.
Figure 5:
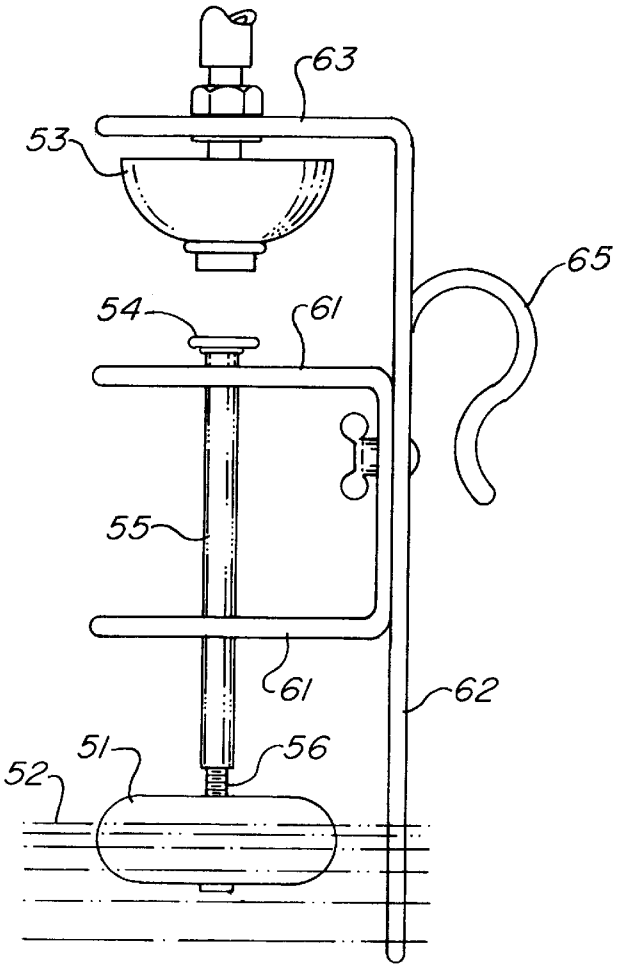
FIG. 5 is a front elevational view of the water level warning device in the embodiment that attaches to the water reservoir by a hook over the side of the water reservoir.
Figure 8:
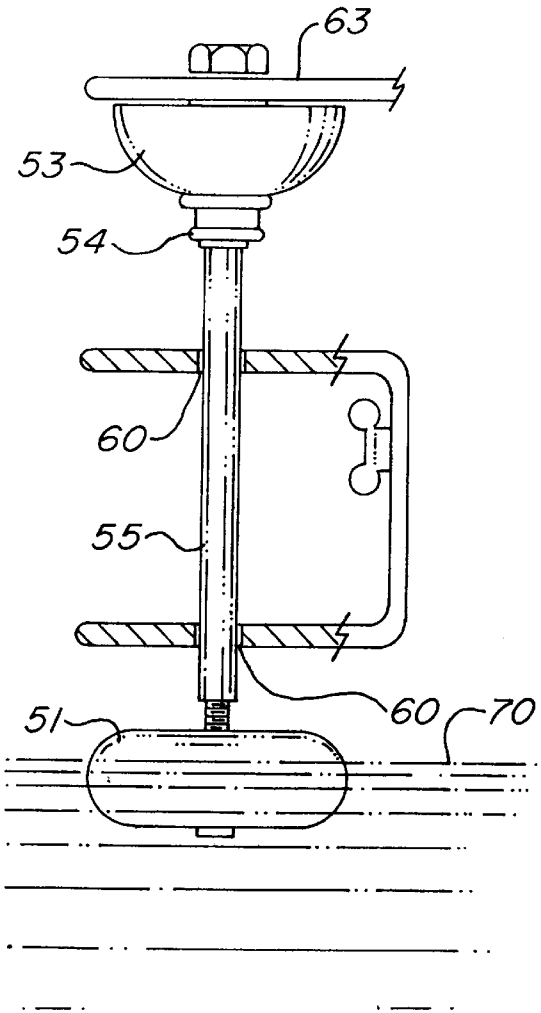
FIG. 8 is a partial front elevational view of the water level warning device with the horizontal guide arms in partial sectional view. In this view the water is such that the striker contacts the bell.
Figure 7:
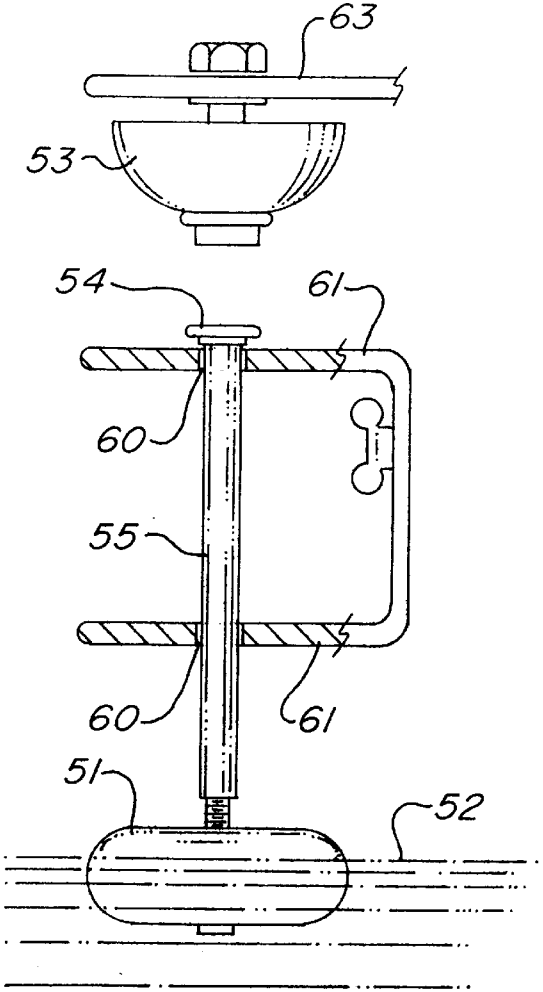
FIG. 7 is a partial front elevational view of the water level warning device with the horizontal guide arms in partial sectional view. In this view the water level is lower than that which would cause the striker to contact the bell.

When filling a water reservoir 10 located in a Christmas tree stand from a remote location where the height of the water in the reservoir 10 cannot be viewed directly, there is a danger of overfilling. Therefore, the present invention provides a warning device 50 to ensure that the reservoir 10 is not filled to overflowing. The warning device 50 comprises a float 51 which rises and falls with the water level 52 in the reservoir 10, a bell 53, and a striker 54 on the float 51 arranged to contact the bell 53 when the correct water level has been reached. The striker 54 is set so that the bell 53 is sounded before the optimum water level 70 is reached so as to take account of the water in the funnel 21 and tube 40 at the point in time when the addition of water is halted. The float 51 is attached to the striker 54 by means of a rod 55 which sets the distance between the float 51 and the striker 54. By adjusting this distance the water level 70 which causes the bell 53 to sound may be adjusted. Various means of adjustment of the distance between the float 51 and the striker 54 would be acceptable in the practice of the present invention. The means shown in FIGS. 5 and 6 is a screw 56 attached to the float 51 and threadedly received in the lower end of the rod 55. The degree to which the float 51 is screwed into the rod 55 determines the distance between the float 51 and the striker 54 and thus the water level 70 in the reservoir 10 which causes the striker 54 to contact the bell 53. Further adjustment is possible by adjusting the position of the horizontal arms 61 with respect to the vertical holder 62.

The rod 55 moves freely vertically through guide openings 60 in one or more horizontal arms 61. The horizontal arms 61 are attached to a vertical holder 62 which also comprises a bell holder 63 which serves to hold the bell 53 in the appropriate position with respect to the striker 54. The horizontal arms 61 may be adjustably mounted to the vertical holder 62. For example, a slot (not shown) may be provided on the vertical holder 62 and the horizontal arms 61 may be fastened to the vertical holder by releasable means such as a wing nut through the slot. Allowing the horizontal arms 61 to be adjusted vertically with respect to the vertical holder 62 provides a greater degree of freedom to assure that the maximum capacity of the reservoir 10 is available to be filled with water before the bell 53 is sounded.

In one embodiment, the vertical holder 62 may be clipped to the lower end of the flexible tubing 40 by means of one or more spring clips 64 of conventional design as shown in FIG. 6. Clamps may also be employed to hold the flexible tube 40 to the warning device 50. In another embodiment, the vertical holder 62 may be provided with a hook 65 to hook over the side of the reservoir 10 as shown in FIGS. 1 and 5. It is desirable that the hook 65 be mounted as low as possible on the vertical holder 62 so that the full capacity of the reservoir is available to be filled before the bell 53 sounds. An effective position for the hook 65 is below the level of the bell 53 and above the uppermost horizontal arm 61.

The present invention has been described with reference to certain preferred and alternative embodiments which are intended to be exemplary only and not limiting to the full scope of the present invention as set forth in the appended claims.

What is claimed is:

1. A Christmas tree watering apparatus for adding water to a water reservoir of a Christmas tree stand, comprising:

funnel means shaped as a Christmas tree ornament, said funnel means having a hollow interior communicating with an outlet, said funnel means having an opening for admitting water to said hollow interior and a hinged section for closing said opening, said hinged section shaped as a portion of said Christmas tree ornament so as to disguise the function of said funnel means when said opening is closed and allowing access to said hollow interior when said opening is opened;

a flexible tube attached to said outlet and communicating through said outlet to said hollow interior of said funnel means and to the water reservoir;

means for hanging said funnel means from a branch of the Christmas tree; and alarm means to warn when the reservoir is filled to a desired height, comprising a float, a rod attached to said float, means to guide said rod vertically, a striker attached to the top of said rod, a bell located so as to intercept said striker when the water in the reservoir is at said desired height, and means for affixing said alarm means at a desired location relative to the reservoir.

2. The Christmas tree watering apparatus of claim 1 wherein said funnel means is spherical in shape.

3. The Christmas tree watering apparatus of claim 1 wherein said means to guide said rod vertically comprises a vertical member and one or more horizontal members, said horizontal members having guide openings aligned vertically for the free passage of said rod.

4. The Christmas tree watering apparatus of claim 3 wherein said means for affixing said alarm means comprises a hook for hooking over a side of the reservoir.

5. The Christmas tree watering apparatus of claim 3 wherein said means for affixing said alarm means comprises one or more clips attached to said vertical member for clipping said vertical member to said tubing.

6. The Christmas tree watering apparatus of claim 1 further comprising means for adjusting the position of said float on said rod.

* * * * *